US008327574B2

(12) United States Patent
Sandler et al.

(10) Patent No.: US 8,327,574 B2
(45) Date of Patent: Dec. 11, 2012

(54) SYSTEM FOR MOUNTING AN ACCESSORY TO A FIREARM

(76) Inventors: Addy Sandler, Huntington Station, NY (US); Itai Vishnia, Setauket, NY (US)

( * ) Notice: Subject to any disclaimer, the term of this patent is extended or adjusted under 35 U.S.C. 154(b) by 112 days.

(21) Appl. No.: 12/610,773

(22) Filed: Nov. 2, 2009

(65) Prior Publication Data

US 2011/0099877 A1 May 5, 2011

(51) Int. Cl.
*F41C 27/00* (2006.01)

(52) U.S. Cl. ..... 42/126

(58) Field of Classification Search ..... 42/90, 124, 42/126, 119, 125, 112, 122, 127, 128; 33/265, 33/263, 266

See application file for complete search history.

(56) References Cited

U.S. PATENT DOCUMENTS

| | | | | | |
|---|---|---|---|---|---|
| 681,202 | A | * | 8/1901 | Zeng | 42/126 |
| 870,295 | A | * | 11/1907 | Johnson | 42/126 |
| 1,816,195 | A | * | 7/1931 | Redfield | 42/127 |
| 2,061,040 | A | * | 11/1936 | Mossberg | 42/126 |
| 2,336,107 | A | * | 12/1943 | Litschert | 42/126 |
| 2,425,130 | A | * | 8/1947 | Shelley | 42/16 |
| 2,739,384 | A | * | 3/1956 | Chokae | 42/126 |
| 2,814,118 | A | * | 11/1957 | Evans et al. | 42/120 |
| 3,406,455 | A | | 10/1968 | Akin, Jr. | |
| 4,216,600 | A | | 8/1980 | Brueckner et al. | |
| 4,461,087 | A | | 7/1984 | Norman | |
| 4,562,658 | A | | 1/1986 | Govett | |
| 4,875,290 | A | * | 10/1989 | Finch | 33/265 |
| 5,086,566 | A | | 2/1992 | Klumpp | |
| 5,414,936 | A | * | 5/1995 | Sappington | 33/265 |
| 5,428,915 | A | | 7/1995 | King | |
| 5,507,272 | A | * | 4/1996 | Scantlen | 124/87 |
| 5,606,818 | A | * | 3/1997 | Hardee | 42/124 |
| 5,787,630 | A | | 8/1998 | Martel | |
| 5,941,226 | A | * | 8/1999 | Marietta | 124/87 |
| 6,026,580 | A | | 2/2000 | LaRue | |
| 6,073,351 | A | * | 6/2000 | Barnett | 42/136 |
| 6,598,333 | B1 | | 7/2003 | Randazzo et al. | |
| 6,609,306 | B2 | * | 8/2003 | Johnson et al. | 33/265 |
| 6,629,381 | B1 | | 10/2003 | King | |
| 6,637,144 | B2 | | 10/2003 | Nelson et al. | |
| 6,648,287 | B2 | | 11/2003 | Wooten et al. | |
| 6,708,439 | B1 | | 3/2004 | Laitala | |
| 6,802,129 | B1 | * | 10/2004 | Wirth | 33/265 |
| 6,931,778 | B1 | | 8/2005 | Nelson et al. | |
| 7,121,037 | B2 | | 10/2006 | Penney | |
| 7,140,143 | B1 | | 11/2006 | Ivey | |
| 7,272,904 | B2 | | 9/2007 | Larue | |
| 7,313,885 | B1 | | 1/2008 | Looney | |
| 7,367,152 | B2 | | 5/2008 | Samson | |
| 2002/0162267 | A1 | | 11/2002 | Nelson et al. | |
| 2006/0123686 | A1 | | 6/2006 | Larue | |
| 2008/0289201 | A1 | * | 11/2008 | Kroening, Jr. | 33/265 |
| 2010/0024228 | A1 | * | 2/2010 | Gibbs et al. | 33/265 |
| 2010/0064535 | A1 | * | 3/2010 | Kingsbury | 33/265 |

* cited by examiner

*Primary Examiner* — Michael Carone
*Assistant Examiner* — Reginald Tillman, Jr.

(57) ABSTRACT

Methods and apparatus for mounting accessories to firearms are described. A base includes a first alignment feature and a clamp that rigidly secures the base to the firearm. An actuator includes an accessory mount and a second alignment feature that engages with the first alignment feature to enable a substantially linear movement of the actuator relative to the base. A fastener secures the actuator to the base at a predetermined position relative to the base.

20 Claims, 12 Drawing Sheets

SYSTEM FOR MOUNTING AN ACCESSORY TO A FIREARM

FIELD OF THE INVENTION

This description relates to methods and systems for mounting an accessory to a firearm.

BACKGROUND

Telescopes ("scopes") and other accessories are typically mounted to a firearm, such as a rifle, using a system of rails and rail mounts. One popular rail is the so-called "Weaver" rail. Another popular rail is the so-called "Picatinny" rail. The Weaver and Picatinny rails allow various mounts, such as ring-mounts, to be rigidly-mounted to the firearm. Rifle scopes are affixed to the firearm using various mounts attached to the rail.

SUMMARY

In one aspect of the invention, an apparatus for mounting an accessory to a firearm is described. The apparatus includes a base having a first alignment feature and a clamp that is adapted to rigidly secure the base to the firearm. An actuator including an accessory mount has a second alignment feature that is adapted to engage with the first alignment feature. The actuator moves in a substantially linear manner relative to the base. A fastener is adapted to secure the actuator to the base at a predetermined position relative to the base.

The base can further include a housing. The actuator is moveable within the housing so as to be telescoping with respect to the housing. In one embodiment, the housing also includes a spring that is adapted to push against the actuator. The fastener can include a latch, pin, machine screw, cap screw, thumbscrew or a setscrew. The accessory can include a magnifier, scope, sight, or a flashlight.

In one embodiment, the second alignment feature includes a rack and the first alignment feature includes a pinion. In one embodiment, the second alignment feature includes a tongue and the first alignment feature includes a groove. In one embodiment, the actuator is movable substantially vertically relative to the base. In another embodiment, the actuator is movable substantially horizontally relative to the base.

The actuator further includes a plurality of detents. Each detent is adapted to align the actuator to a different position relative to the base. In one embodiment, the plurality of detents are arranged to provide a fine adjustment of the position of the actuator relative to the base. In one embodiment, the accessory mount is movable between an engaged position and a disengaged position. The accessory mount is located closer to the base in the engaged position than in the disengaged position.

In another aspect, a method of mounting an accessory to a firearm is described. The method includes attaching a base having a first alignment feature to the firearm. The method also includes, positioning an actuator including an accessory mount and a second alignment feature adjacent to the base such that the second alignment feature engages with the first alignment feature. The accessory is attached to the accessory mount. The actuator is secured to the base at a predetermined position relative to the base In one embodiment, positioning an actuator includes moving the actuator within a housing of the base. In one embodiment, positioning the actuator includes moving the accessory mount in a substantially vertical direction relative to the firearm. In another embodiment, positioning the actuator includes aligning the accessory mount in a direction that is parallel to a longitudinal axis of a barrel of the firearm. In one embodiment, the accessory mount is moved between an engaged position and a disengaged position. The accessory mount is located closer to the base in the engaged position than in the disengaged position.

In another aspect, the base includes a first alignment feature and has a clamp adapted to secure the base to the firearm. An actuator includes a second alignment feature adapted to engage with the first alignment feature to enable a substantially linear movement of the actuator relative to the base. An accessory mount is coupled to the actuator and adapted to receive the accessory. A fastener is adapted to secure the actuator to the base at a predetermined position relative to the base.

In one embodiment, the accessory mount is coupled to the actuator with one of a screw, a pin, a rivet, a weld, a joint, or a glue. In one embodiment, the first alignment feature includes a channel and the second alignment feature includes a ridge. In one embodiment, the base further includes a housing and the actuator is moveable within the housing so as to be telescoping with respect to the housing. A spring is adapted to push against the actuator.

In one embodiment, the accessory mount is movable between an engaged position and a disengaged position. The accessory mount is located closer to the base in the engaged position than in the disengaged position.

BRIEF DESCRIPTION OF THE DRAWINGS

This invention is described with particularity in the detailed description. The above and further advantages of this invention may be better understood by referring to the following description in conjunction with the accompanying drawings, in which like numerals indicate like structural elements and features in various figures. The drawings are not necessarily to scale, emphasis instead being placed upon illustrating the principles of the invention.

DETAILED DESCRIPTION

Figure 1:
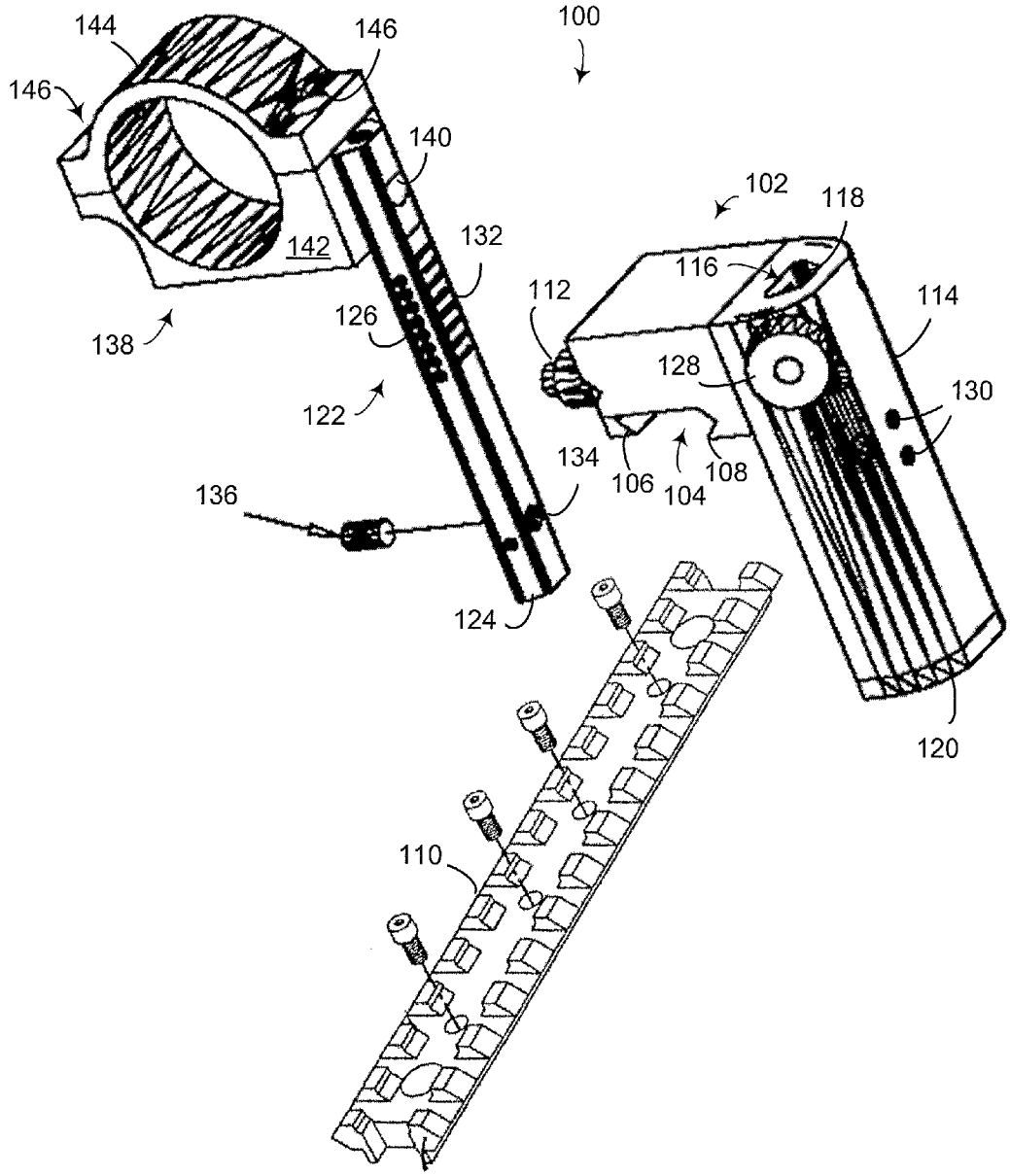
FIG. 1 illustrates an accessory mounting system according to one embodiment of the invention.

The following detailed description is merely illustrative in nature and is not intended to limit the invention or the application and uses of the invention. Furthermore, there is no intention to be bound by any expressed or implied theory presented in the preceding technical field, background, brief summary or the following detailed description.

The present specification discloses one or more embodiments that incorporate the features of the invention. The disclosed embodiment(s) merely exemplify the invention. The scope of the invention is not limited to the disclosed embodiment(s). The invention is defined by the claims appended hereto.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

Furthermore, it should be understood that spatial descriptions (e.g., "above," "below," "up," "left," "right," "down," "top," "bottom," "vertical," "horizontal," etc.) used herein are for purposes of illustration only, and that practical implementations of the structures described herein can be spatially arranged in any orientation or manner.

The invention may be described herein in terms of functional and/or logical block components and various processing steps. It should be appreciated that such block components may be realized by any number of hardware components configured to perform the specified functions. In addition, those skilled in the art will appreciate that the present invention may be practiced in conjunction with any number of weapons and mounting systems and that the system described herein is merely one exemplary application for the invention.

For the sake of brevity, conventional techniques related to mounting accessories to firearms and other functional aspects of the systems (and the individual operating components of the systems) may not be described in detail herein. Furthermore, the connecting lines shown in the various figures contained herein are intended to represent example functional relationships and/or physical couplings between the various elements. It should be noted that many alternative or additional functional relationships or physical connections may be present in a practical embodiment.

The following description refers to elements or features being "connected" or "coupled" together. As used herein, unless expressly stated otherwise, "connected" means that one element/feature is directly joined to (or directly communicates with) another element/feature, and not necessarily mechanically. Likewise, unless expressly stated otherwise, "coupled" means that one element/feature is directly or indirectly joined to (or directly or indirectly communicates with) another element/feature, and not necessarily mechanically. Thus, although various figures may depict example arrangements of elements, additional intervening elements, devices, features, or components may be present in an actual embodiment (assuming that the functionality of the device is not adversely affected).

FIG. 1 illustrates an accessory mounting system 100 according to one embodiment of the invention. The accessory mounting system 100 includes a base 102 including a clamp 104 having a movable jaw 106 and an opposed mounting feature 108. The movable jaw 106 is configured to rigidly mount the clamp 104 to a mounting rail 110 of a firearm. The movable jaw 106 can be secured using a thumb screw 112, or other suitable fastener.

A housing 114 including a channel 116 can be mechanically coupled to the clamp 104. Alternatively, the clamp 104 and the housing 114 can be formed from a single piece of suitable material. For example, the material used for the housing 114 and/or the clamp 104 can be a metal material, such as stainless steel, aluminum, carbon steel, or titanium. The material can also be a plastic, such as a polymer material.

The channel 116 includes a first alignment feature 118. In this embodiment, the first alignment feature 118 is the shape of the channel 116. For example, the cross-sectional shape of the channel 116 can be an isosceles trapezoid. In practice, any suitable shape can be used. The housing 114 can include a cover 120 that attaches to one end of the housing 114. In one embodiment, the housing 114 includes a spring (not shown) that is located substantially inside the housing 114.

An actuator 122 includes a second alignment feature 124. The second alignment feature 124 is shaped to engage with the first alignment feature 118. For example, the actuator 122 slides inside the channel 116 to enable a substantially linear movement of the actuator 122 relative to the channel 116. The length of the actuator 122 is determined by the desired range of motion of the actuator 122. The material used for the actuator 122 can be a metal material, such as stainless steel, aluminum, carbon steel, or titanium. The material can also be a plastic, such as a polymer material.

Skilled artisans will appreciate that various mechanical techniques can be used to design and engage the first alignment feature 118 and the second alignment feature 124. For example, bearings can be used between the actuator 122 and the channel 116. In another example, the actuator 122 and the channel 116 are machined to precise tolerances so that the actuator 122 slides inside the channel 116 without excess gaps that could cause "slop" or "play" between the actuator 122 and the channel 116. Oil or grease can be used between the components. In one embodiment, the first alignment feature is a tongue and the second alignment feature is a groove.

The actuator 122 includes one or more detents 126. The detents 126 align with a fastener 128 in the housing 114 that secures the actuator 122 to the housing 114 at a predetermined position. In one embodiment, the fastener 128 is a thumbscrew. In practice, the fastener 128 can be a machine screw or any other suitable fastener. The thumbscrew 112 can include a spring-loaded tip (not shown). The spring urges the tip to engage with a detent 126 when the actuator 122 is inserted in the channel 116.

The housing 114 can include additional apertures 130 adapted to receive fasteners (not shown) for securing an optional accessory mount (not shown) to the housing 114. In one embodiment, ridges 132 in the actuator 122 engage with an optional latch (not shown). In one embodiment, the latch is spring loaded and can be used to temporarily secure the position of the actuator 122 relative to the housing 114.

The actuator 122 can include an aperture 134 for receiving a pin 136. The pin 136 engages a feature (not shown) in the housing 114 to prevent the actuator 122 from being unintentionally removed from the housing 114.

In one embodiment, the actuator 122 is coupled to a ring mount 138 using a dowel 140. The dowel 140 is shaped to prevent the ring mount 138 from rotating relative to the actuator 122. The ring mount 138 includes a bottom portion 142 and a top portion 144. The top portion 144 is attached to the bottom portion 142 using fasteners (not shown) inserted into apertures 146 in the top portion 144. The fasteners engage with threads (not shown) that are formed in the bottom portion 142 of the ring mount 138. Various other accessories can be attached to the actuator 122 instead of the ring mount 138. For example, a mounting rail (not shown) can be attached to the actuator 122.

In operation, the base 102 is secured by the clamp 104 to the rail 110 of a firearm, such as a rifle, for example. The actuator 122 is inserted into the channel 116 of the housing 114. The top portion 144 of the ring mount 138 is removed and an accessory (not shown) is positioned in the bottom portion 142 of the ring mount 138. The accessory is secured to the ring mount 138 by attaching the top portion 144 to the bottom portion 142. Various accessories can be held in the ring mount 138, such as scopes, magnifiers, sights, or flashlights, for example.

Once the accessory is attached to the ring mount 138, the actuator 122 is moved to the optimal vertical position relative to the rail 110 of the firearm. The actuator 122 is then secured to the base 102 (housing 114) with the fastener 128. Loosening the fastener 128 and sliding the actuator 122 changes the vertical position of the accessory relative to the rail 110. The length of the actuator 122 and the position of the pin 136 determine the range of motion of the actuator 122.

In one embodiment, the bottom of the actuator 122 is positioned against a compression spring (not shown) in the channel 116. The spring applies a force against the actuator 122, thereby urging the actuator 122 upward. The spring causes the actuator 122 to move upward when the thumbscrew 128 is sufficiently loosened to disengage with the detent 126 in the actuator 122.

Figure 2:
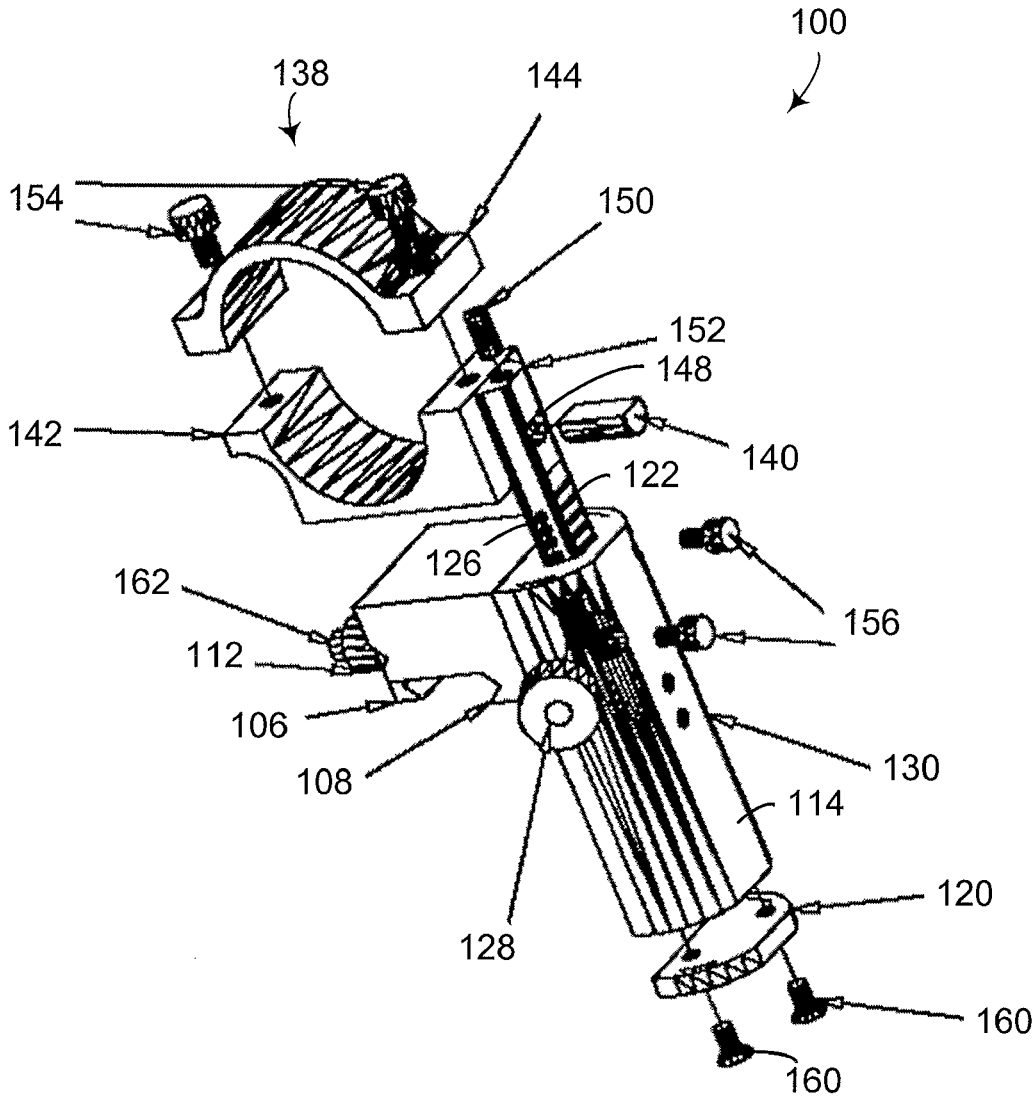
FIG. 2 illustrates the accessory mounting system of FIG. 1 partially assembled.

FIG. 2 illustrates the accessory mounting system 100 of FIG. 1 partially assembled. In this embodiment, the actuator 122 is partially inserted into the housing 114.

The actuator 122 is moveable within the housing 114 so as to be telescoping with respect to the housing 114. In one embodiment, the actuator 122 can be located in a first position corresponding to an engaged position and a second position corresponding to a disengaged position. The ring mount 138 is nearer to the housing 114 when the actuator 122 is in the engaged position than in the disengaged position.

In one embodiment, a spring (not shown) is located within the housing. The end of the actuator 122 that is positioned inside the housing 114 can be situated against the spring. The spring is adapted to force the actuator 122 to move telescopically relative to the housing 114 when the spring is decompressed.

To secure the ring mount 138 to the actuator 122, the dowel 140 is inserted into an aperture 148 and secured using a set screw 150 inserted into a threaded aperture 152. The dowel 140 can be formed from a suitable material, such as stainless steel. The dowel 140 and the corresponding aperture 148 in the actuator 122 are shaped to prevent the ring mount 138 from rotating relative to the actuator 122. In one embodiment, the dowel 140 is of sufficient length to allow the ring mount 138 to be secured by the set screw 150 at different lateral positions relative to the actuator 122. In one embodiment, the dowel 140 and the bottom portion 142 of the ring mount 138 are formed from a single piece of material. In another embodiment, the dowel 140 is pressed into the bottom portion 142 of the ring mount 138. In practice, the actuator 122 can be coupled to the ring mount 138 through other mechanical techniques.

The ring mount 138 is shown for illustrative purposes only. In practice, the dowel 140 can engage with various other accessory mounts, including a rail or a custom mount, for example.

The top portion 144 of the ring mount 138 is secured to the bottom portion 142 using cap head screws 154. The housing 114 includes two screws 156 that mate with the two threaded apertures 130 in the housing 114. The two screws 156 engage with an optional accessory mount (not shown) that can be attached to the actuator 114. The thumbscrew 128 engages with the detents 126 in the actuator 122. The bottom cover 120 is attached to the housing two screws 160.

The movable jaw 106 is secured using thumbscrew 112. In one embodiment, another thumbscrew 162 having a smaller diameter than the thumbscrew 112 is used to lock the movable jaw 106 relative to the mounting feature 108.

Figure 3:
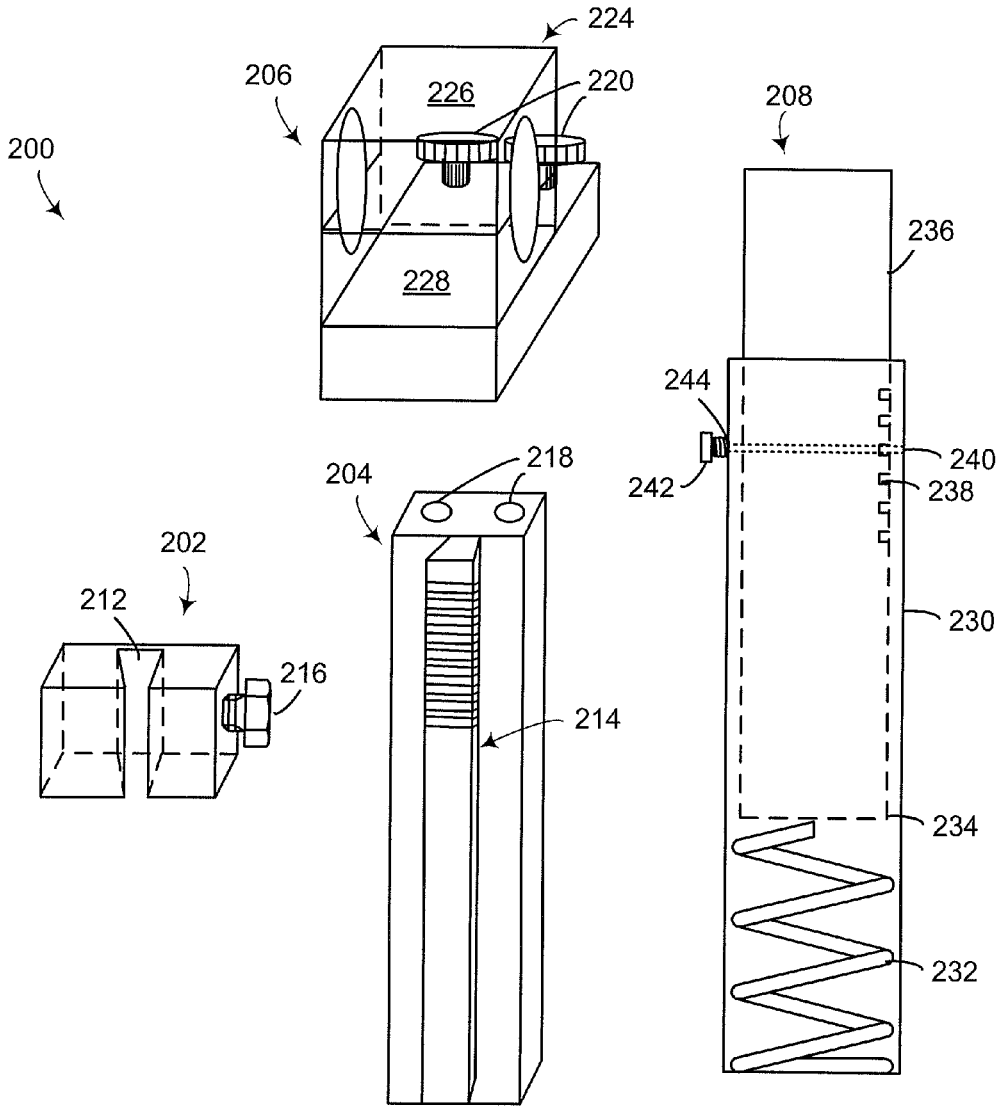
FIG. 3 illustrates four highly schematic components of an accessory mounting system according to the invention.

FIG. 3 illustrates four highly schematic components 202, 204, 206, 208 of an accessory mounting system 200 according to the invention. The components 202, 204, 206 are shown disassembled from each other for clarity. A highly schematic drawing of a housing assembly 208 is illustrated in a partially assembled state.

The first component is a base 202. The base 202 includes a first alignment feature that is in the shape of a channel or a groove 212. The first alignment feature 212 is adapted to engage with a second alignment feature 214 on the actuator component 204. A fastener 216 is used to secure the actuator 204 to the base 202.

The second alignment feature on the actuator 204 is in the shape of a tongue 214. The tongue 214 is formed along the entire length of the actuator 204 for illustrative purposes. In practice, the tongue 214 can be formed along only a portion of the actuator 204 or the tongue 214 can be segmented along the length of the actuator 204. In one embodiment, the groove 212 and tongue 214 are shaped so as to capture the tongue 214 within the groove 212. In this embodiment, the actuator 204 can move linearly relative to the base 202. The fastener 216 is adapted to lock the actuator 204 to the base 202 when the actuator 204 is in its desired position relative to the base 202.

The actuator 204 includes two threaded holes 218 adapted to align with screws 220. The screws 220 are adapted to attach an accessory mount 206 to the actuator 204. The accessory mount 206 includes a ring mount 224 having a top portion 226 and a bottom portion 228. The ring mount 224 is designed to grasp cylindrically-shaped accessories.

The housing assembly 208 includes a housing 230. The housing 230 contains a spring 232. A bottom end 234 of an actuator 236 inserted into the housing 230 contacts the spring 232. The actuator 236 includes a plurality of ridges or grooves 238 that are spaced apart from each other. A latch 240 is adapted to engage with one of the grooves 238 in the actuator 236. The spring 232 provides a spring force that urges the groove 238 against the latch 240, thereby temporarily securing the actuator 236 to the housing 230. The latch 240 can include a button 242 and a spring 244. When the button 242 is pressed, the latch 240 disengages with the groove 238. This causes the spring 232 to decompress, thereby forcing the actuator 236 to move upward. The speed and distance with which the actuator 236 moves is dependent on the length and properties of the spring 232.

Figure 4:
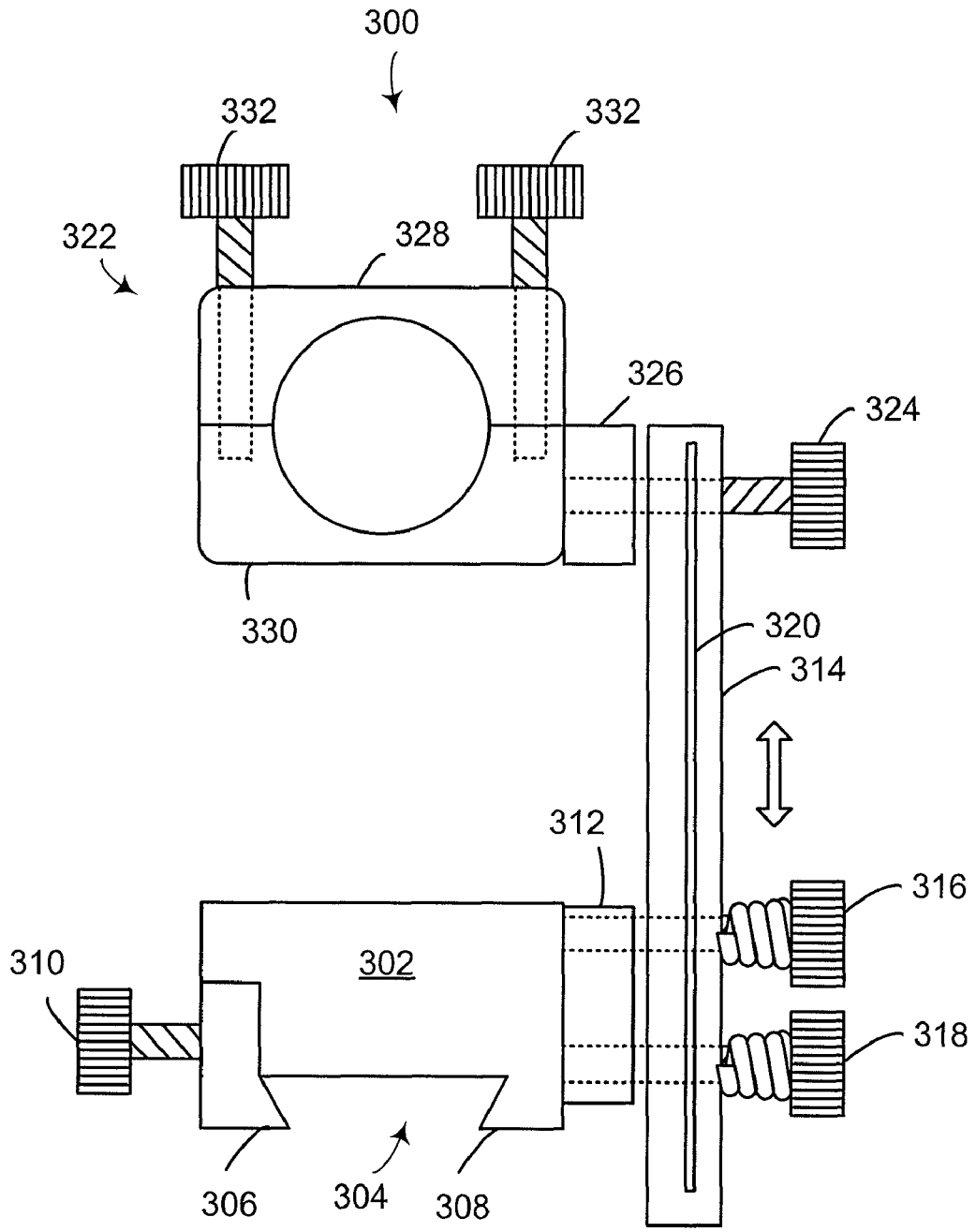
FIG. 4 illustrates an accessory mounting system according to another embodiment of the invention.

FIG. 4 illustrates an accessory mounting system 300 according to another embodiment of the invention. The accessory mounting system 300 includes a base 302. The base 302 includes a clamp 304 having a movable jaw 306 and a mounting feature 308. The movable jaw 306 is locked using fastener 310. The base 302 can also include a spacer 312. The spacer 312 includes a first alignment feature (not shown).

An actuator 314 is coupled to the spacer 312 with two fasteners 316, 318. The actuator 314 includes a second alignment feature 320. In this embodiment, the second alignment feature 320 is a slot. The slot is formed along the length of the actuator 314. The length of the slot and the position of the fasteners 316, 318 determine the range of motion of the actuator 314.

The actuator 314 is rigidly coupled to an accessory mount 322 using a fastener 324. A spacer 326 can be inserted between the accessory mount 322 and the actuator 314. In one embodiment, the fastener 324 can secure the spacer 326 to the accessory mount 322. In one embodiment, the spacer 326 and the spacer 312 have the same thickness. In other embodiments, the spacer 326 and the spacer 312 have different thicknesses.

The accessory mount 322 shown is a ring mount having a top portion 328 and a bottom portion 330. The top portion 328 is secured to the bottom portion 330 using two fasteners 332. Other accessory mounts, such as a rail (not shown), can also be used. In other embodiments, accessory mounts for supporting customized components (not shown) can be attached to the actuator 314.

Figure 5:
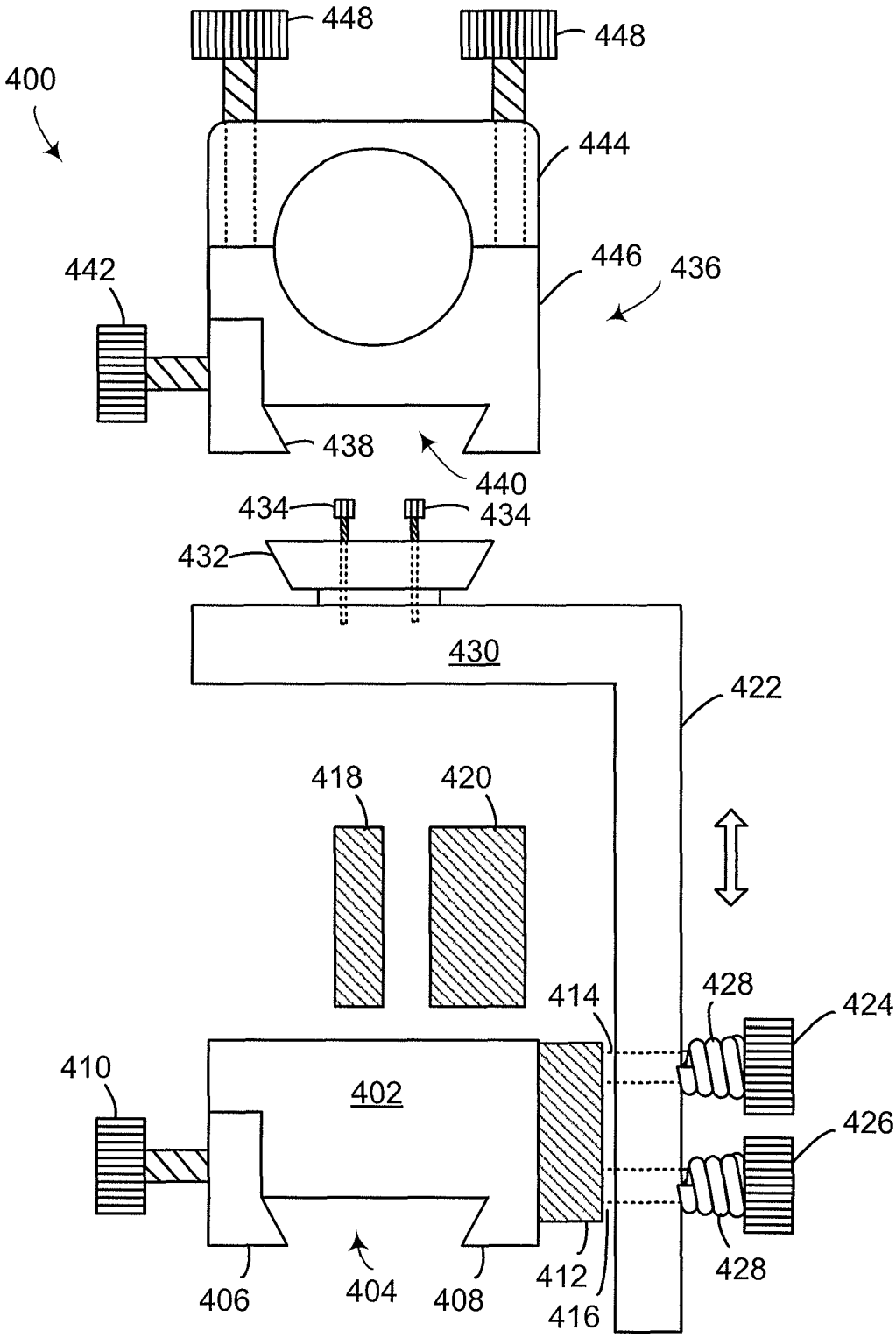
FIG. 5 illustrates an accessory mounting system according to another embodiment of the invention.

FIG. 5 illustrates an accessory mounting system 400 according to another embodiment of the invention. The accessory mounting system 400 includes a base 402. The base 402 includes a clamp 404 having a movable jaw 406 and a mounting feature 408. The movable jaw 406 is locked using fastener 410. The base 402 can also include a spacer 412. The spacer 412 includes a first alignment feature. The first alignment feature is a pair of mounting holes 414, 416. In other embodiments, the first alignment feature can be a groove or channel, for example. In other embodiments, the first alignment feature can be a ridge or tongue.

In one embodiment, the spacer 412 is interchangeable with other spacers 418, 420 having different dimensions. The thickness of the spacer 412 determines the lateral position of an actuator 422 relative to the base 402.

The actuator 422 is coupled to the spacer 412 with two fasteners 424, 426. One or both of the fasteners 424, 426 can include a spring 428 that urges the actuator 422 towards the base 402. The spring 422 is adapted to continually to apply a holding force between the actuator 422 and the base 402 when the fasteners 424, 426 are not completely tightened.

The actuator 422 includes a second alignment feature. In this embodiment, the second alignment feature is a slot (not shown). The slot is formed along the length of the actuator 422. The slot is adapted to allow the actuator 422 to move substantially vertically relative to the base 402. The length of the slot and the position of the fasteners 424, 426 determine the range of motion of the actuator 422. In this embodiment, the actuator 422 includes an integrated arm 430.

A rail 432 is rigidly coupled to the arm 430 of the actuator 422 using the fasteners 434. The rail 432 can be any desired length. The rail 432 is adapted to accept one or more standard mounts, such as a ring mount 436, for example.

The ring mount 436 is rigidly coupled to the rail 432 by securing the movable jaw 438 of the clamp 440 to the rail 432 using the fastener 442. The top portion 444 of the ring mount 436 is coupled to the bottom portion 446 using the fasteners 448. In other embodiments, accessory mounts for supporting customized components (not shown) can be attached to the arm 430 of the actuator 422.

In operation, the base 402 is rigidly coupled to a rail (not shown) by tightening the fastener 410 to lock the clamp 404 to the rail. The actuator 422 is attached to the base 402 using the fasteners 424, 426 and the optional spacer 412. Next, an accessory, such as a magnifier (not shown), is secured in the ring mount 436. The fasteners 424, 426 are loosened, and the actuator 422 is adjusted vertically until the desired position is determined. The desired position can correspond to an engaged position. The fasteners 424, 426 are then tightened to secure the actuator 422 to the base 402. In one embodiment, the fasteners 424, 426 include the springs 428 that urge the actuator 422 against the spacer 412.

The actuator 422 can be rapidly repositioned from the engaged position to a disengaged position by simply loosening the fasteners 424, 426 and pulling the ring mount 436 away from the base 402 in a vertical direction. The springs 428 hold the actuator 422 in the disengaged position when the fasteners 424, 426 are not completely tightened. The actuator 422 can be repositioned to an engaged position and the fasteners 424, 426 re-tightened as desired.

Figure 6:
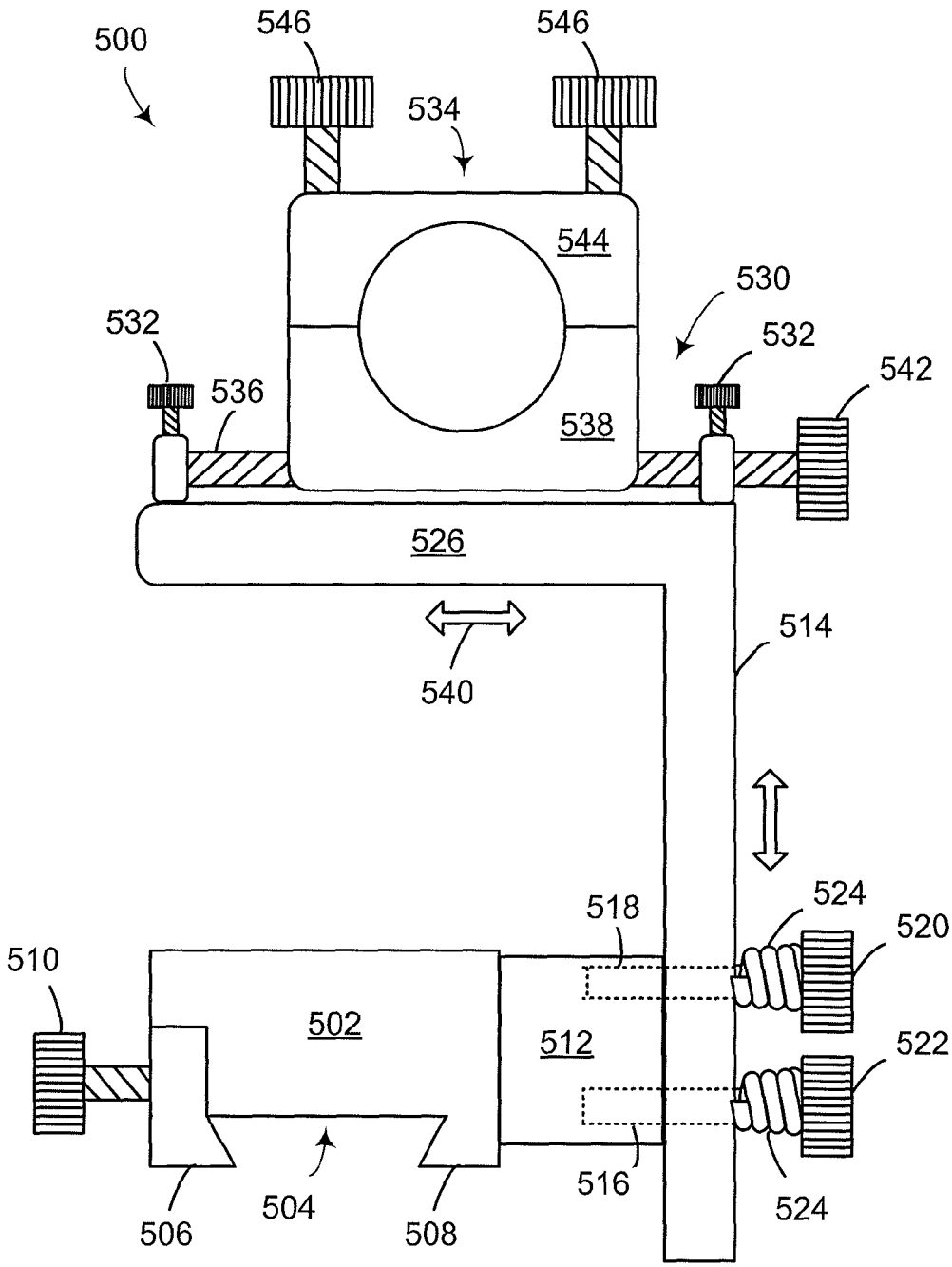
FIG. 6 illustrates an accessory mounting system according to another embodiment of the invention.

FIG. 6 illustrates an accessory mounting system 500 according to another embodiment of the invention. The accessory mounting system 500 includes a base 502. The base 502 includes a clamp 504 having a movable jaw 506 and a mounting feature 508. The movable jaw 506 is locked using fastener 510. The base 502 can also include a spacer 512. The spacer 512 includes a first alignment feature. The thickness of the spacer 512 determines the lateral position of an actuator 514 relative to the base 502. The first alignment feature is a pair of mounting holes 516, 518. In other embodiments, the first alignment feature can be a groove or channel, for example. In other embodiments, the first alignment feature can be a ridge or tongue.

The actuator 514 is coupled to the spacer 512 with two fasteners 520, 522. One or both of the fasteners 520, 522 can include a spring 524 that urges the actuator 514 towards the base 502. The spring 524 is adapted to continually to apply a holding force between the actuator 514 and the base 502 when the fasteners 520, 522 are not completely tightened.

The actuator 514 includes a second alignment feature. In this embodiment, the second alignment feature is a slot (not shown). The slot is formed along the length of the actuator 514. The slot is adapted to allow the actuator 514 to move substantially vertically relative to the base 502. The length of the slot and the position of the fasteners 520, 522 determine the range of motion of the actuator 514. In this embodiment, the actuator 514 includes an integrated arm 526.

A lateral positioning device 530 is rigidly coupled to the arm 526 of the actuator 514 using the fasteners 532. The arm 526 and the lateral positioning device 530 can be any desired length. The lateral positioning device 530 can be adapted to accept one or more standard mounts or an accessory rail, for example. In the embodiment shown, a ring mount 534 is coupled to the lateral positioning device 530.

In one embodiment, the lateral positioning device 530 includes a worm gear 536 that is coupled to the bottom portion 538 of the ring mount 534. The ring mount 534 can be moved in a lateral direction 540 by rotating the worm gear 536 with the thumbscrew 542. Rotating the thumbscrew 542 counterclockwise translates the ring mount 534 in one direction and rotating the thumbscrew 542 clockwise translates the ring mount 534 in the opposite direction. When the ring mount 534 is in the desired position, the ring mount 534 is prevented from moving laterally by securing the worm gear 536 using the fasteners 532.

The top portion 544 of the ring mount 534 is coupled to the bottom portion 538 using the fasteners 546. In other embodiments, accessory mounts for supporting customized components (not shown) can be attached to the lateral positioning device 530.

In operation, the base 502 is rigidly coupled to a rail (not shown) by tightening the fastener 510 to lock the clamp 504 to the rail. The actuator 524 is attached to the base 502 using the fasteners 520, 522 and the optional spacer 512. Next, an accessory, such as a magnifier (not shown), is secured in the ring mount 534. The fasteners 520, 522 are loosened, and the actuator 514 is adjusted vertically until the desired vertical position is determined. The desired vertical position can correspond to an engaged position. The fasteners 520, 522 are then tightened to secure the actuator 514 to the base 502. In one embodiment, the fasteners 520, 522 include springs 524 that urge the actuator against the spacer 512.

Next, the ring mount 534 is positioned laterally by turning the thumbscrew 542 either clockwise or counterclockwise. When the desired position is reached, the fasteners 532 are tightened, thereby preventing the worm gear 536 from rotating.

The actuator 524 can be rapidly repositioned from the engaged position to a disengaged position by simply loosening the fasteners 520, 522 and pulling the ring mount 534 away from the base 502 in a vertical direction. The springs 524 hold the actuator 514 in the disengaged position when the fasteners 520, 522 are not completely tightened. The actuator 514 can be repositioned to an engaged position and the fasteners 520, 522 re-tightened as desired.

Figure 7:
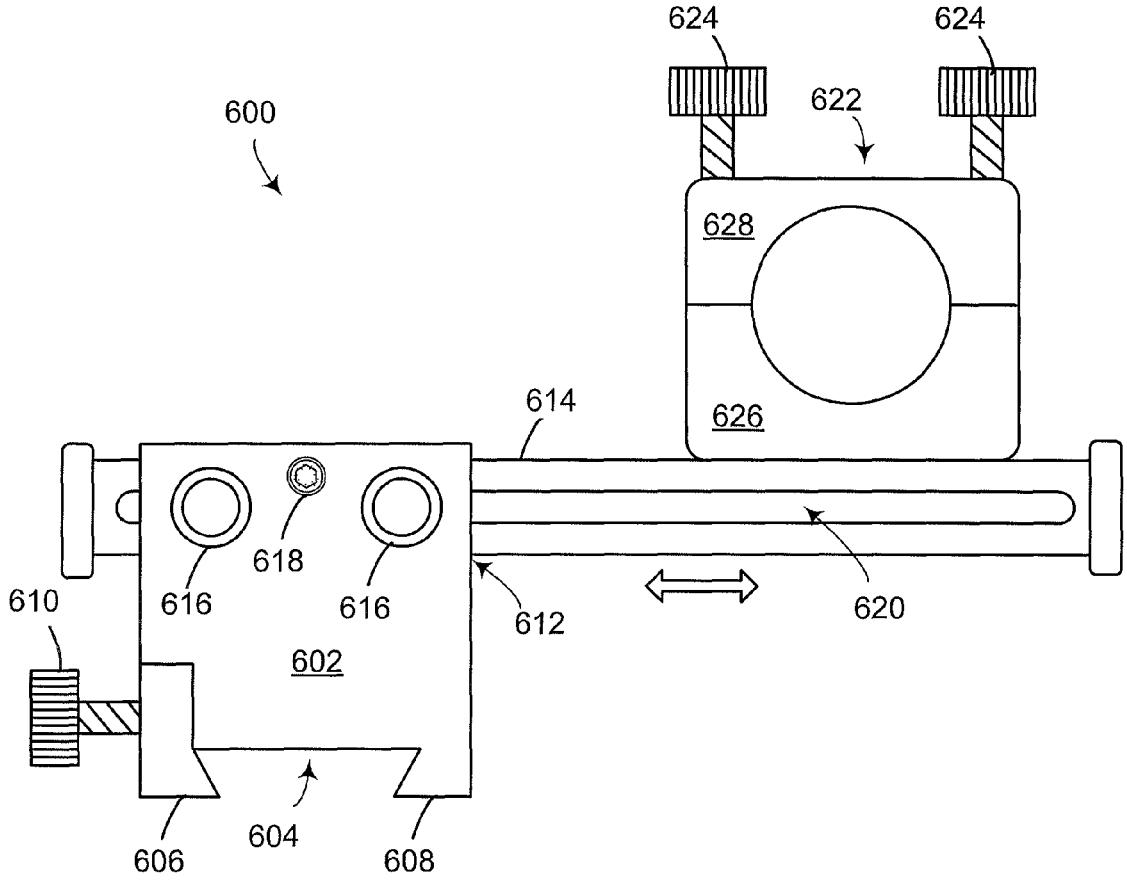
FIG. 7 illustrates an accessory mounting system according to another embodiment of the invention.

FIG. 7 illustrates an accessory mounting system 600 according to another embodiment of the invention. The accessory mounting system 600 includes a base 602. The base 602 includes a clamp 604 having a movable jaw 606 and a mounting feature 608. The movable jaw 606 is locked using fastener 610. The base 602 can also include a first alignment feature. In one embodiment, the first alignment feature is a groove 612. In other embodiments, the first alignment feature can be a ridge or tongue.

An actuator 614 is adapted to fit in the groove 612 of the base 602. The actuator 614 is secured to the base 602 using two fasteners 616. One or both of the fasteners 616 can include a spring (not shown) that temporarily secures the actuator 614 to the base 602. The spring is adapted to continually to apply a holding force between the actuator 614 and the base 602 when the fasteners 616 are not completely tightened. In one embodiment, another fastener 618 prevents the actuator 614 from moving relative to the base 602.

The actuator 614 includes a second alignment feature. In one embodiment, the second alignment feature is a slot 620. The slot 620 is fanned along the length of the actuator 614. The slot 620 is adapted to allow the actuator 614 to move substantially laterally relative to the base 602. The length of the slot 620 and the position of the fasteners 616 determine the range of motion of the actuator 614.

A ring mount 622 is rigidly coupled to the actuator 614 using a fasteners 624. In one embodiment, other fasteners (not shown) can be used to secure the bottom portion 626 of the ring mount 622 to the actuator 614.

The ring mount 622 includes a top portion 628 and the bottom portion 626. The top portion 628 is secured to the bottom portion 626 using the two fasteners 624. Other accessory mounts, such as a rail (not shown), can also be used. In other embodiments, accessory mounts for supporting customized components (not shown) can be attached to the actuator 614.

In operation, the base 602 is rigidly coupled to a rail (not shown) by tightening the fastener 610 to lock the clamp 604 to the rail. The actuator 614 is attached to the base 602 using the fasteners 616 and/or the optional fastener 618. Next, an accessory, such as a magnifier (not shown), is secured in the ring mount 622. The fasteners 616 are loosened, and the actuator 614 is adjusted laterally until the desired position is determined. The desired position can correspond to an engaged position. The fasteners 616 are then tightened to secure the actuator 614 to the base 602. In one embodiment, the fasteners 616 can include springs that urge the actuator against the base 602.

The actuator 614 can be rapidly repositioned from the engaged position to a disengaged position by simply loosening the fasteners 616, 618 and pulling the ring mount 622 away from the base 602 in a lateral direction. The springs hold the actuator 614 in the disengaged position when the fasteners 616, 618 are not completely tightened. The actuator 614 can be repositioned to an engaged position and the fasteners 616, 618 re-tightened as desired.

Figure 8:
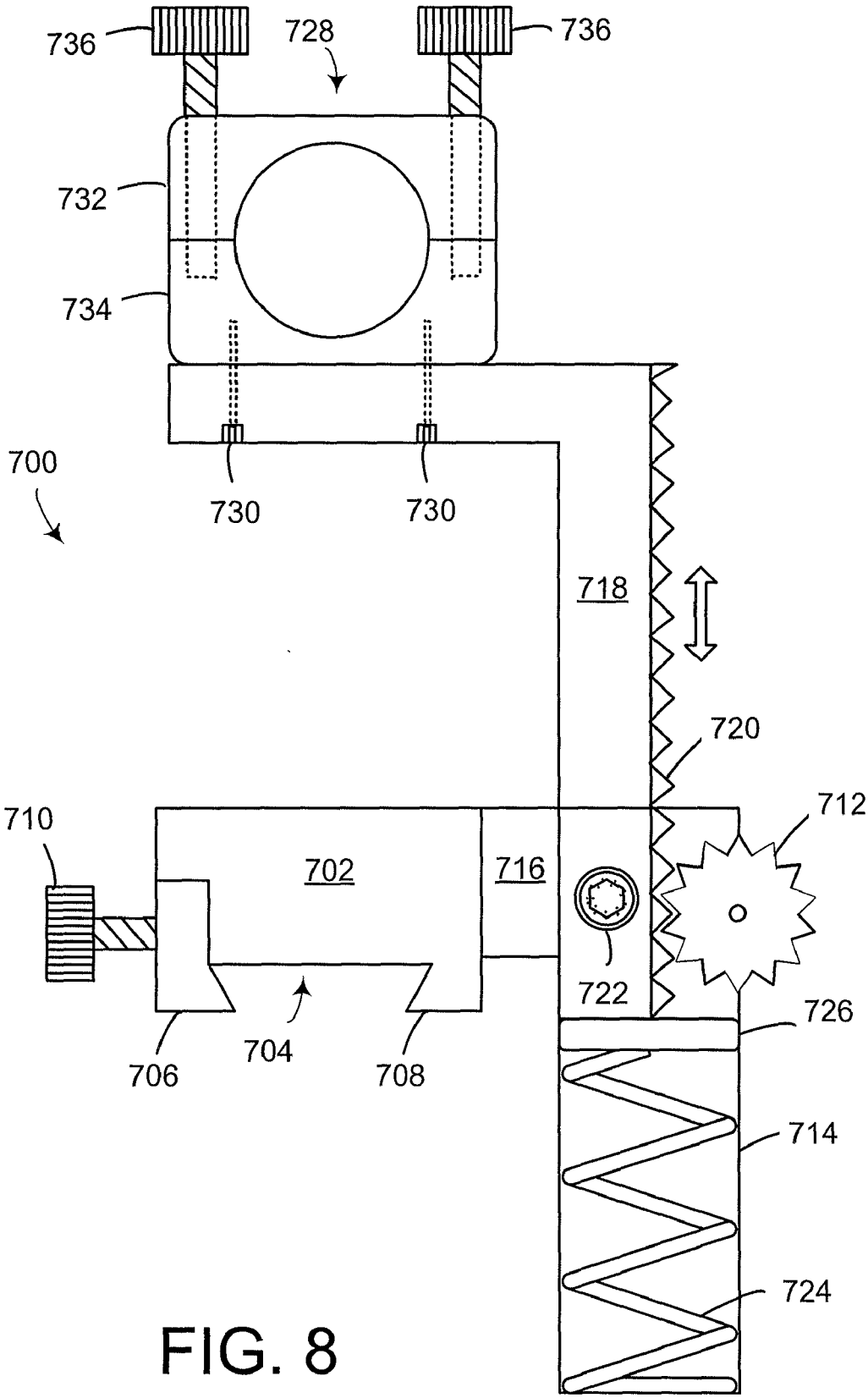
FIG. 8 illustrates an accessory mounting system according to another embodiment of the invention.

FIG. 8 illustrates an accessory mounting system 700 according to another embodiment of the invention. The accessory mounting system 700 includes a base 702. The base 702 includes a clamp 704 having a movable jaw 706 and a mounting feature 708. The movable jaw 706 is locked using fastener 710. The base 702 can also include a first alignment feature. In one embodiment, the first alignment feature is a gear or pinion 712. The base 702 can also include a housing 714. In one embodiment, the housing 714 is rigidly coupled to the base 702. A spacer 716 can positioned between the housing 714 and the base 702. In another embodiment, the housing 714 and the base 702 are formed from a single piece of material.

An actuator 718 is adapted to be movable within the housing 714. The actuator 718 includes a second alignment feature. In one embodiment, the second alignment feature is a rack 720. The pinion 712 is adapted to engage with the rack 720. In one embodiment, the pinion 712 can be rotated by the user to adjust the position of the actuator 718 relative to the base 702. A fastener 722 can be used to secure the actuator 718 to the base 702. In one embodiment, the tip of the fastener (not shown) can include a spring that provides a holding force that holds the actuator 718 relative to the base 702. In one embodiment, the actuator 718 can include a plurality of detents (not shown) that are adapted to receive the spring loaded tip.

The housing 714 can contain a spring 724. The bottom end 726 of the actuator 718 can be positioned to contact the spring 724. The spring 724 is adapted to urge the actuator 718 away from the base 702. In one embodiment, the spring 724 is used to mitigate any backlash between the rack 720 and pinion 712.

A ring mount 728 is rigidly coupled to the actuator 718 using a fasteners 730. The ring mount 728 includes a top portion 732 and the bottom portion 734. The top portion 732 is secured to the bottom portion 734 using the two fasteners 736. Other accessory mounts, such as a rail (not shown), can also be used. In other embodiments, accessory mounts for supporting customized components (not shown) can be attached to the actuator 718.

In operation, the base 702 is rigidly coupled to a rail (not shown) by tightening the fastener 710 to lock the clamp 704 to the rail. The actuator 718 is situated in the housing 714 such that the rack 720 is engaged with the pinion 712. An accessory, such as a magnifier (not shown), is secured in the ring mount 728. The fastener 722 is loosened, and the actuator 718 is adjusted vertically until the desired position is determined. The desired position can correspond to an engaged position. The fastener 722 is then tightened to secure the actuator 718 to the base 702.

The actuator 718 can be rapidly repositioned from the engaged position to a disengaged position by simply loosening the fastener 722. The spring 724 expands, thereby pushing the actuator 718 away from the base 702 in a vertical direction. The spring 724 is of sufficient strength to hold the actuator 718 in the disengaged position. The actuator 718 can be repositioned to an engaged position and the fastener 722 re-tightened as desired.

Figure 9A:
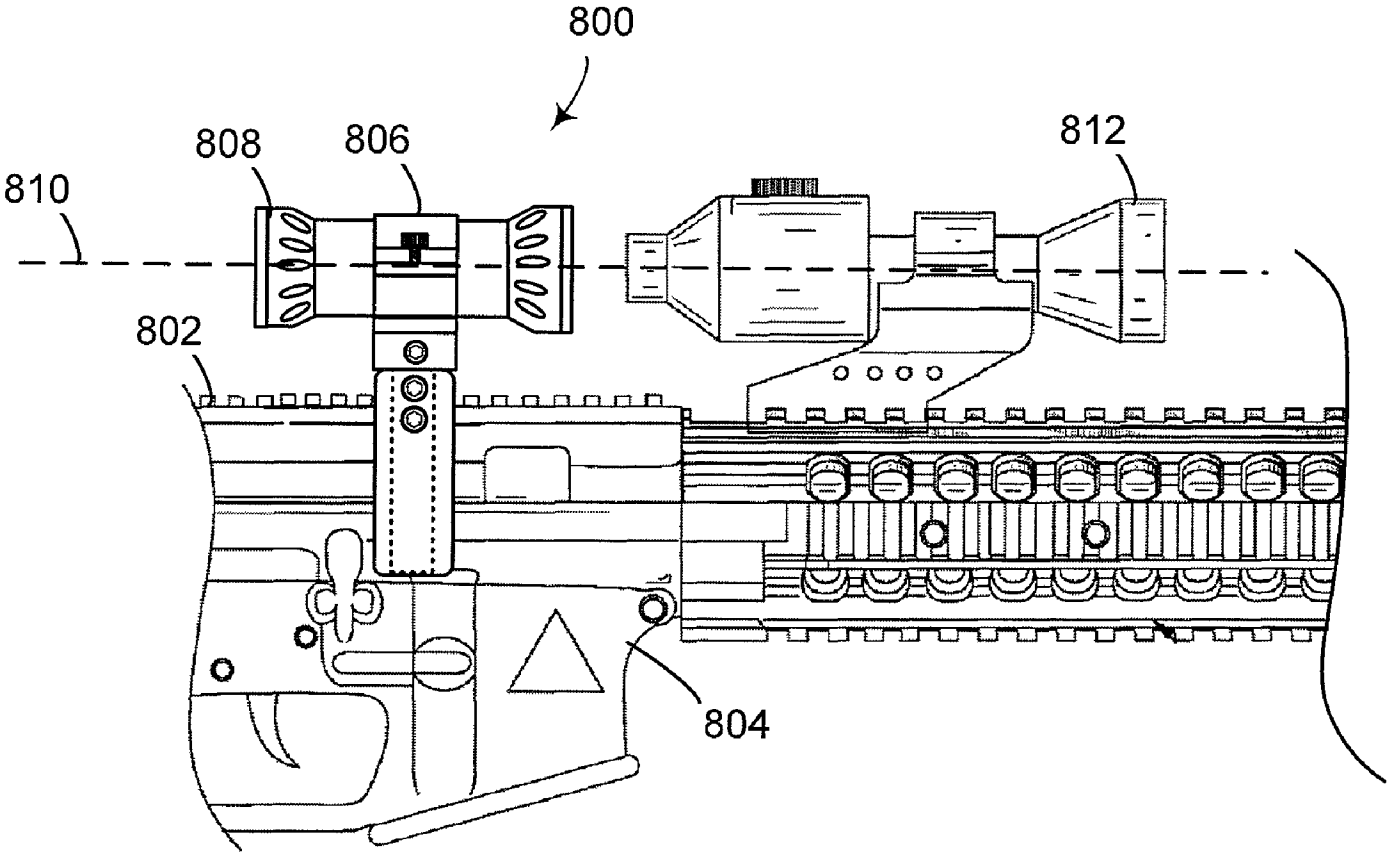
FIG. 9A illustrates an accessory mounting system attached to a rail of a firearm according to an embodiment of the invention.

FIG. 9A illustrates an accessory mounting system 800 attached to a rail 802 of a firearm 804 according to an embodiment of the invention. The accessory mounting system 800 can be mounted on either side of the firearm 804. The accessory mounting system 800 includes an accessory mount 806. A magnifier 808 is mounted in the accessory mount 806. The magnifier 808 is shown in the engaged position 810 corresponding to a position of a forward-mounted aiming sight 812.

Figure 9B:
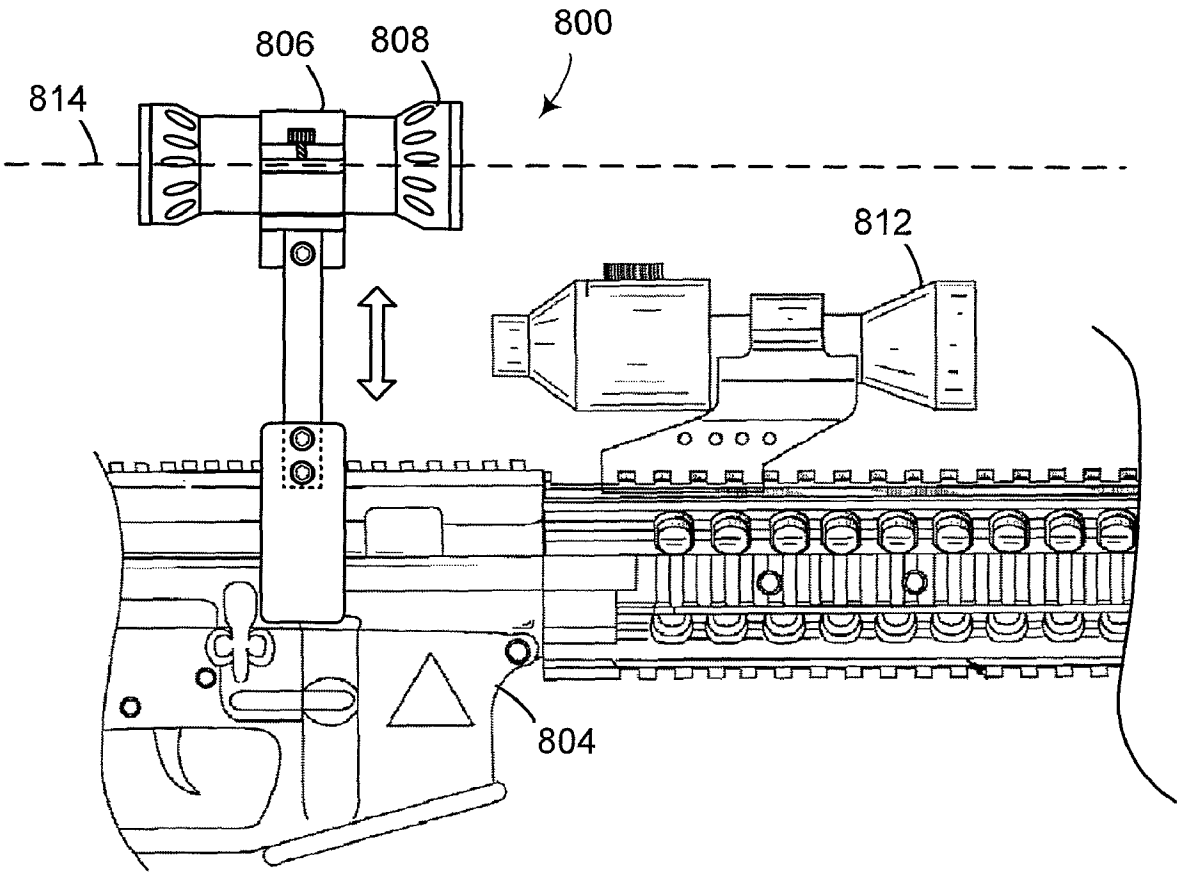
FIG. 9B illustrates the accessory mounting system of FIG. 9A showing the accessory mount in the disengaged position.

FIG. 9B illustrates the accessory mounting system 800 of FIG. 9A showing the accessory mount 806 in the disengaged position 814. In the disengaged position, the magnifier 808 is positioned above the forward-mounted aiming sight 812 so as to provide an unobstructed view of the aiming sight 812.

Figure 10A:
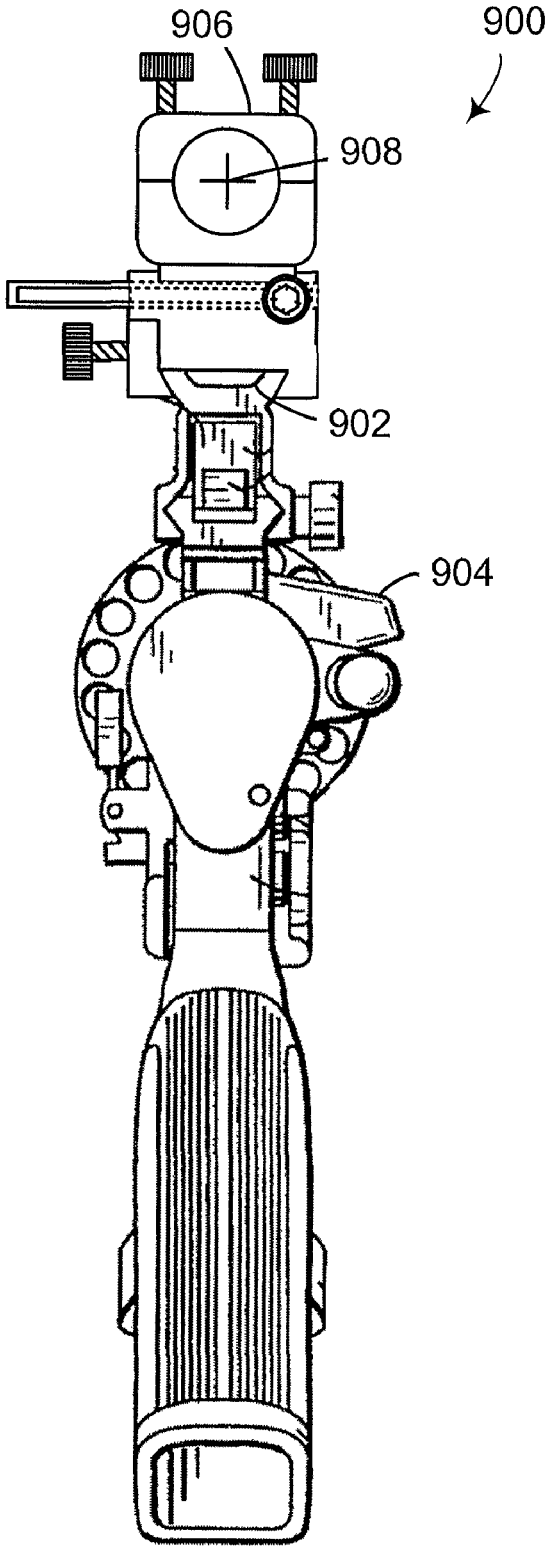
FIG. 10A illustrates an accessory mounting system attached to a rail of a firearm according to an embodiment of the invention.

FIG. 10A illustrates an accessory mounting system 900 attached to a rail 902 of a firearm 904 according to an embodiment of the invention. The accessory mounting system 900 can be mounted on either side of the firearm 904. The accessory mounting system 900 includes an accessory mount 906. An accessory (not shown) can be mounted in the accessory mount 906. The accessory mount 906 is shown in an engaged position 908.

Figure 10B:
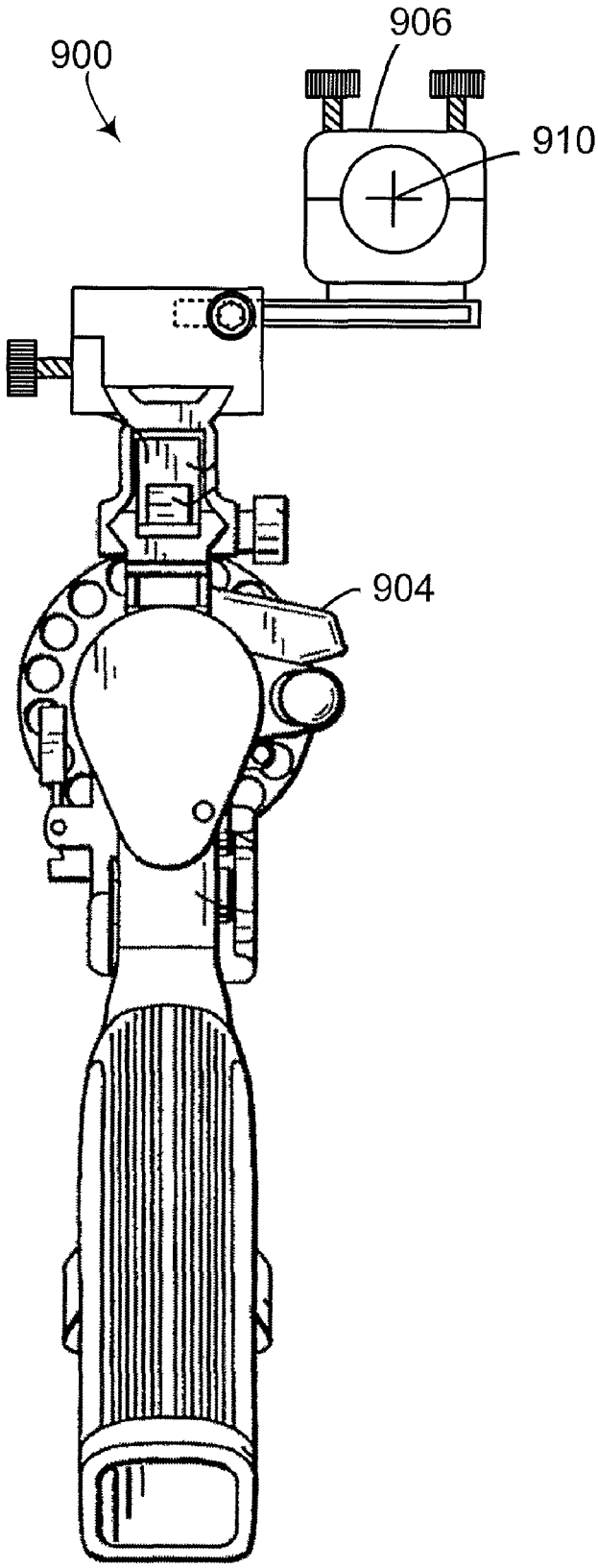
FIG. 10B illustrates the accessory mounting system of FIG. 10A showing the accessory mount in the disengaged position.

FIG. 10B illustrates the accessory mounting system 900 of FIG. 10A showing the accessory mount 906 in the disengaged position 910. In the disengaged position 910, the accessory mount 906 is positioned to the right of the firearm 904 so as to provide a clear view along a longitudinal axis of the firearm 904.

The foregoing description is intended to be merely illustrative of the present invention and should not be construed as limiting the appended claims to any particular embodiment or group of embodiments. Thus, while the present invention has been described with reference to exemplary embodiments, it should also be appreciated that numerous modifications and alternative embodiments may be devised by those having ordinary skill in the art without departing from the broader and intended spirit and scope of the present invention as set forth in the claims that follow. In addition, the section headings included herein are intended to facilitate a review but are not intended to limit the scope of the present invention. Accordingly, the specification and drawings are to be regarded in an illustrative manner and are not intended to limit the scope of the appended claims.

In interpreting the appended claims, it should be understood that:

a) the word "comprising" does not exclude the presence of other elements or acts than those listed in a given claim;

b) the word "a" or "an" preceding an element does not exclude the presence of a plurality of such elements;

c) any reference signs in the claims do not limit their scope;

d) several "means" may be represented by the same item or hardware or software implemented structure or function;

e) any of the disclosed devices or portions thereof may be combined together or separated into further portions unless specifically stated otherwise; and f) no specific sequence of acts or steps is intended to be required unless specifically indicated.

What is claimed is:

1. An apparatus for mounting an accessory to a firearm, comprising:

a base comprising a pinion and a clamp adapted to rigidly secure the base to the firearm;

an actuator comprising an accessory mount and a rack adapted to engage with the pinion to enable a substantially linear movement of the actuator relative to the base;

a fastener adapted to secure the actuator to the base at a predetermined position relative to the base; and a spring adapted to automatically move the actuator relative to the base when the actuator is unsecured from the base.

2. The apparatus of claim 1 wherein the base further comprises a housing and the actuator is moveable within the housing so as to be telescoping with respect to the housing.

3. The apparatus of claim 1 wherein the spring decompresses when the actuator is unsecured from the base.

4. The apparatus of claim 1 wherein the fastener comprises one of a latch, pin, machine screw, cap screw, thumbscrew and a setscrew.

5. The apparatus of claim 1 wherein the accessory comprises one of a magnifier, scope, sight, and a flashlight.

6. The apparatus of claim 1 wherein the actuator is movable substantially vertically relative to the base.

7. The apparatus of claim 1 wherein the actuator is movable substantially horizontally relative to the base.

8. The apparatus of claim 1 wherein the actuator further comprises a plurality of detents, each detent being adapted to align the actuator to a different position relative to the base.

9. The apparatus of claim 1 wherein the accessory mount is movable between an engaged position and a disengaged position, the accessory mount being located closer to the base in the engaged position than in the disengaged position.

10. The apparatus of claim 1, further comprising a linear positioning device coupled between the actuator and the accessory mount, the linear positioning device being adapted to adjust a lateral position of the accessory mount relative to the actuator.

11. The apparatus of claim 1, further comprising a vertical positioning device coupled between the base and the actuator, the vertical positioning device being adapted to adjust a vertical position of the actuator relative to the base before the actuator is secured to the base.

12. A method of mounting an accessory to a firearm, comprising:

attaching a base comprising a pinion to the firearm;

positioning an actuator comprising an accessory mount and a rack adjacent to the base such that the rack engages with the pinion;

attaching the accessory to the accessory mount;

securing the actuator to the base at a predetermined position relative to the base; and automatically moving the actuator relative to the base when the actuator is unsecured from the base.

13. The method of claim 12 wherein positioning an actuator comprises moving the actuator within a housing of the base.

14. The method of claim 12 wherein positioning the actuator comprises moving the accessory mount in a substantially vertical direction relative to the firearm.

15. The method of claim 12 wherein positioning the actuator comprises aligning the accessory mount in a direction that is parallel to a longitudinal axis of a barrel of the firearm.

16. The method of claim 12 further comprising moving the accessory mount between an engaged position and a disengaged position, the accessory mount being located closer to the base in the engaged position than in the disengaged position.

17. An apparatus for mounting an accessory to a firearm, comprising:

a base comprising a pinion and having a clamp adapted to secure the base to the firearm;

an actuator comprising a rack adapted to engage with the pinion to enable a substantially linear movement of the actuator relative to the base;

an accessory mount coupled to the actuator and adapted to receive the accessory;

a fastener adapted to secure the actuator to the base at a predetermined position relative to the base; and a spring adapted to automatically move the actuator relative to the base when the actuator is unsecured from the base.

18. The apparatus of claim 17 wherein the accessory mount is coupled to the actuator with at least one of a screw, a pin, a rivet a weld, a joint, and a glue.

19. The apparatus of claim 17 wherein the base further comprises a housing and the actuator is moveable within the housing so as to be telescoping with respect to the housing.

20. The apparatus of claim 17 wherein the accessory mount is movable between an engaged position and a disengaged position, the accessory mount being located closer to the base in the engaged position than in the disengaged position.

* * * * *